US008794999B2

(12) United States Patent
Schuckmann et al.

(10) Patent No.: US 8,794,999 B2
(45) Date of Patent: Aug. 5, 2014

(54) HERMETIC TERMINAL HAVING PIN-ISOLATING FEATURE

(75) Inventors: Scott Schuckmann, Maineville, OH (US); Albertus Jan Hendrik Kolkman, Dalen (NL)

(73) Assignee: Emerson Electric Co., St. Louis, MO (US)

( * ) Notice: Subject to any disclaimer, the term of this patent is extended or adjusted under 35 U.S.C. 154(b) by 60 days.

(21) Appl. No.: 13/572,225

(22) Filed: Aug. 10, 2012

(65) Prior Publication Data

US 2014/0045355 A1 Feb. 13, 2014

(51) Int. Cl.
*H01R 13/40* (2006.01)

(52) U.S. Cl.
USPC ..... 439/587

(58) Field of Classification Search
USPC ..... 439/271, 587, 276, 282, 685; 174/50.52
See application file for complete search history.

(56) References Cited

U.S. PATENT DOCUMENTS

| | | | | |
|---|---|---|---|---|
| 4,461,925 | A | 7/1984 | Bowsky et al. | |
| 4,984,973 | A * | 1/1991 | Itameri-Kinter et al. | 417/422 |
| 5,017,740 | A | 5/1991 | Honkomp et al. | |
| 5,035,653 | A * | 7/1991 | Honkomp et al. | 439/620.33 |
| 5,129,843 | A * | 7/1992 | Bowsky et al. | 439/685 |
| 5,131,858 | A | 7/1992 | Heimbrock | |
| 5,391,061 | A * | 2/1995 | Iizuka et al. | 417/410.1 |
| 5,584,716 | A * | 12/1996 | Bergman | 439/282 |
| 6,107,566 | A * | 8/2000 | Quadir et al. | 174/50.52 |
| 6,273,754 | B1 * | 8/2001 | Bunch et al. | 439/587 |
| 6,441,311 | B2 * | 8/2002 | Fukumoto et al. | 174/138 F |
| 6,509,525 | B2 * | 1/2003 | Honkomp et al. | 174/50.52 |
| 6,632,104 | B2 * | 10/2003 | Quadir | 439/587 |
| 6,699,078 | B2 * | 3/2004 | Quadir | 439/693 |
| 6,844,502 | B2 * | 1/2005 | Deng et al. | 174/151 |
| 6,851,962 | B2 * | 2/2005 | McCormack, III | 439/276 |
| 6,916,210 | B2 * | 7/2005 | Moore et al. | 439/685 |
| 7,025,614 | B2 * | 4/2006 | Herrick et al. | 439/276 |
| 7,108,489 | B2 * | 9/2006 | Yap | 417/410.1 |
| 7,997,931 | B2 * | 8/2011 | Cocquyt et al. | 439/587 |
| 8,257,113 | B2 * | 9/2012 | Cocquyt et al. | 439/587 |
| 8,262,372 | B2 * | 9/2012 | Wang et al. | 417/410.1 |
| 2003/0008542 | A1 | 1/2003 | Schoepf et al. | |
| 2007/0035910 | A1 | 2/2007 | Stevenson | |
| 2011/0250769 | A1 | 10/2011 | Wang et al. | |

OTHER PUBLICATIONS

"Glass-to-metal hermetic seals and power terminal feed-throughs" FUSITE Tech-Data [Bulletin 962A], Fusite Division of Emerson Electric Co., ©1996 Fusite Division of Emerson Electric Co., p. 1-4.
"Glass-to-metal hermetic seals, connectors and related components" FUSITE [Brochure], Fusite Division of Emerson Electric Co., © 1999 Fusite Division of Emerson Electric Co., p. 1-8.
International Search Report and Written Opinion for PCT/US2013/050294, mailed Dec. 30, 2013; ISA/US.

* cited by examiner

*Primary Examiner* — Alexander Gilman
(74) *Attorney, Agent, or Firm* — Harness, Dickey & Pierce, P.L.C.

(57) ABSTRACT

A hermetic terminal is disclosed as having a body including an exterior surface and a plurality of openings in the body accommodating a pin extending through each opening that is hermetically sealed and electrically isolated from the body. The terminal also includes a dielectric pin-isolating feature forming a barrier that increases the operative through-air spacing between the pins of the terminal. The power rating for the terminal is thereby increased without increasing the overall size of the terminal.

33 Claims, 5 Drawing Sheets

HERMETIC TERMINAL HAVING PIN-ISOLATING FEATURE

FIELD

The present disclosure relates to hermetic power terminal feed-throughs, and more particularly to hermetic power terminal feed-throughs employing dielectric over-surface protection for preventing electrical shorting of the terminal.

BACKGROUND

This section provides background information related to the present disclosure which is not necessarily prior art.

Conventional, hermetically-sealed, electric power terminal feed-throughs (also referred to as "hermetic terminals") provide an airtight electrical terminal for use in conjunction with hermetically sealed devices, such as A/C compressors, where leakage into or from such devices, by way of the terminals, is effectively precluded. For hermetically-sealed electric power terminal feed-throughs to function safely and effectively for their intended purpose, the hermetic terminals require that their conductor pins be electrically isolated from, and hermetically sealed to, the body of the terminal through which they pass. In addition, an optimum through-air path between adjacent portions of the pins the opposite sides of the body, as well as between the pins themselves, must be established and thereafter maintained to minimize the possibility for generating an electrical short circuit at the terminal.

An exemplary hermetic terminal 1 and associated connector block 2 having constructions that are well-known in the art are shown in FIGS. 1-4. In such conventional hermetic terminals 1, an electrically conductive pin is fixed in place within an aperture through a metal body by a fusible sealing glass that forms a hermetic, glass-to-metal seal between the pin and the terminal body.

A resilient electrical insulator is bonded to the outside surface of the body, as well as over the glass-to-metal seal and portions of the current-conducting pins. The insulator provides a dielectric over-surface covering for substantial portions of the outside surface of the terminal body and the conductor pins. In doing so, the insulator increases a path through the air between adjacent non-insulated portions of the conductor pins and the terminal body (though not between the pins in their entirety) and reduces the ability for contaminants, debris, and the like (e.g., metal shavings) to form unwanted current paths that could create an electrical short circuit at the terminal between the pin and the body.

Optionally, a connector block 2 like that shown in FIGS. 2, 3A and 3B may be used in conjunction with the hermetic terminal 1. As illustrated in FIGS. 3A and 3B, the connector block 2 cooperatively engages with the ends of the plurality of conductor pins of the hermetic terminal 1 and provides a mounting fixture for attaching to the hermetic terminal lead wires that can be electrically connected to a power source disposed on one side of the hermetic terminal 1.

SUMMARY

This section provides a general summary of the disclosure, and is not a comprehensive disclosure of its full scope or all of its features.

The disclosure provides a hermetic terminal having a body member with a generally flat bottom wall and at least a first opening in the wall. At least two electrically conductive pins, where at least one electrically-conductive pin extends through each of the first openings, are hermetically sealed within the first openings with a dielectric sealing material. Means for increasing the operative through-air spacing between adjacent ones of the electrically-conductive pins is also provided and enables a smaller diameter hermetic terminal to meet UL power requirement specifications for hermetic terminals for applications that would have previously required a larger diameter hermetic terminal. Consequently, a smaller diameter hermetic terminal can be used in higher voltage applications. Further, the pressure rating for a compressor using a smaller diameter hermetic terminal can be increased because of the smaller footprint of the terminal in the compressor which can withstand higher pressures and enabling the use of higher pressure refrigerants.

In another aspect of the disclosure, a hermetic terminal has a cup-shaped metallic body member including a generally flat bottom wall and a peripheral side wall. The bottom wall has an exterior surface and a plurality of first openings. A plurality of current-conducting pins extending through the first openings. A dielectric sealing material extending between and hermetically sealing the current-conducting pins is included within the first openings. A dielectric pin-isolating feature attached to the body member increases the operative through-air spacing between the current-conducting pins and includes a lower base portion and an upper barrier portion. The base portion is sized and shaped to closely fit the periphery of the exterior surface of the bottom wall. The upper barrier portion has a plurality of generally vertically-upstanding, generally planar ribs extending from the base portion, in a direction generally parallel to a central axis of the hermetic terminal. The ribs terminate beyond the outer ends of the current-conducting pins.

In still another aspect of the disclosure, a hermetic terminal has a body including a wall having an exterior surface and a plurality of first openings. A current-conducting pin extends through each first opening, and the pins are sealed within the openings and electrically isolated from the body. A dielectric barrier is attached to the body that is sized and shaped to closely fit the periphery of the exterior surface of the wall. The barrier includes a plurality of ribs that extend in a first direction generally parallel to a longitudinal axis of the pins and terminate in the first direction beyond the outer ends of the pins. The barrier increases the operative through-air spacing between the pins of the hermetic terminal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
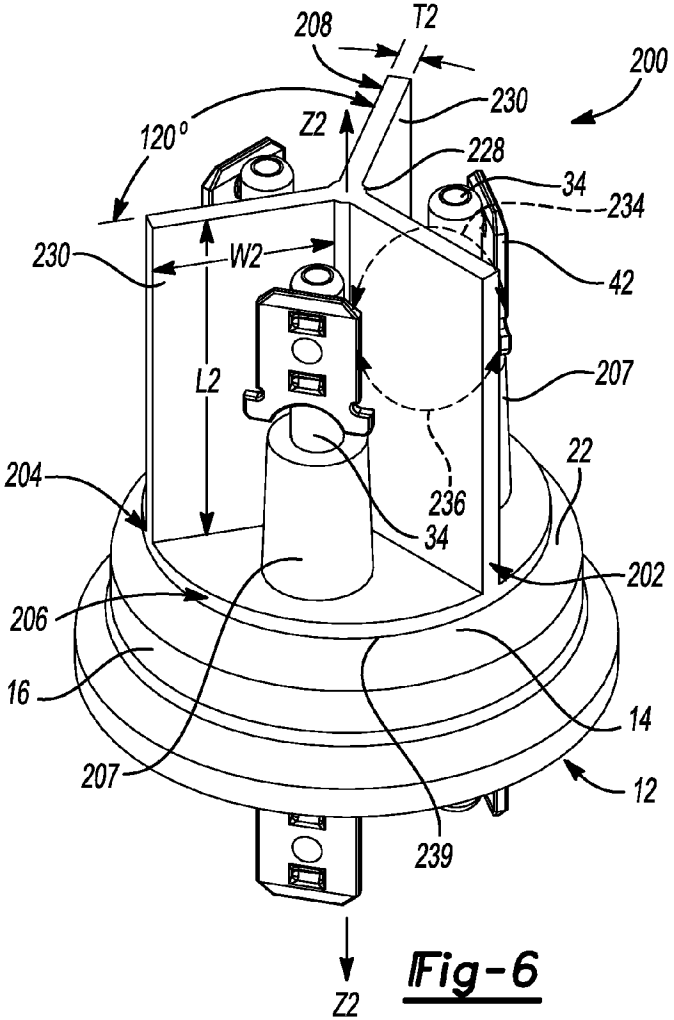
FIG. 6 is a front perspective view of a second embodiment of a hermetic terminal of the present disclosure.
Figure 5:
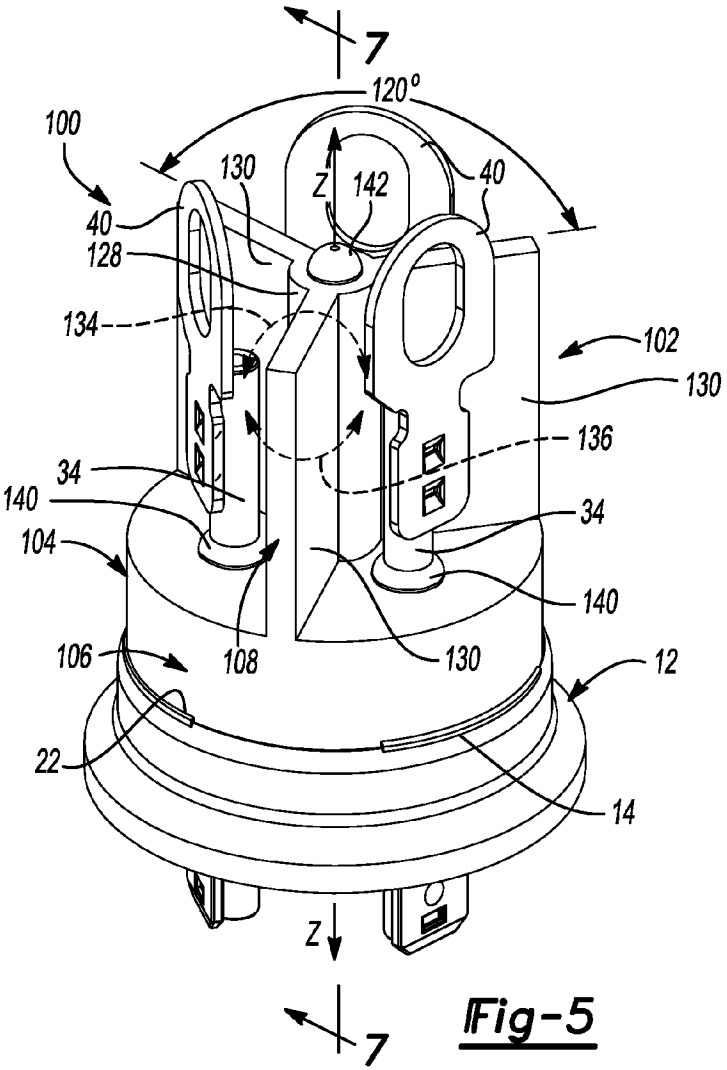
FIG. 5 is a front perspective view of a first embodiment of a hermetic terminal of the present disclosure.
Figure 7A:
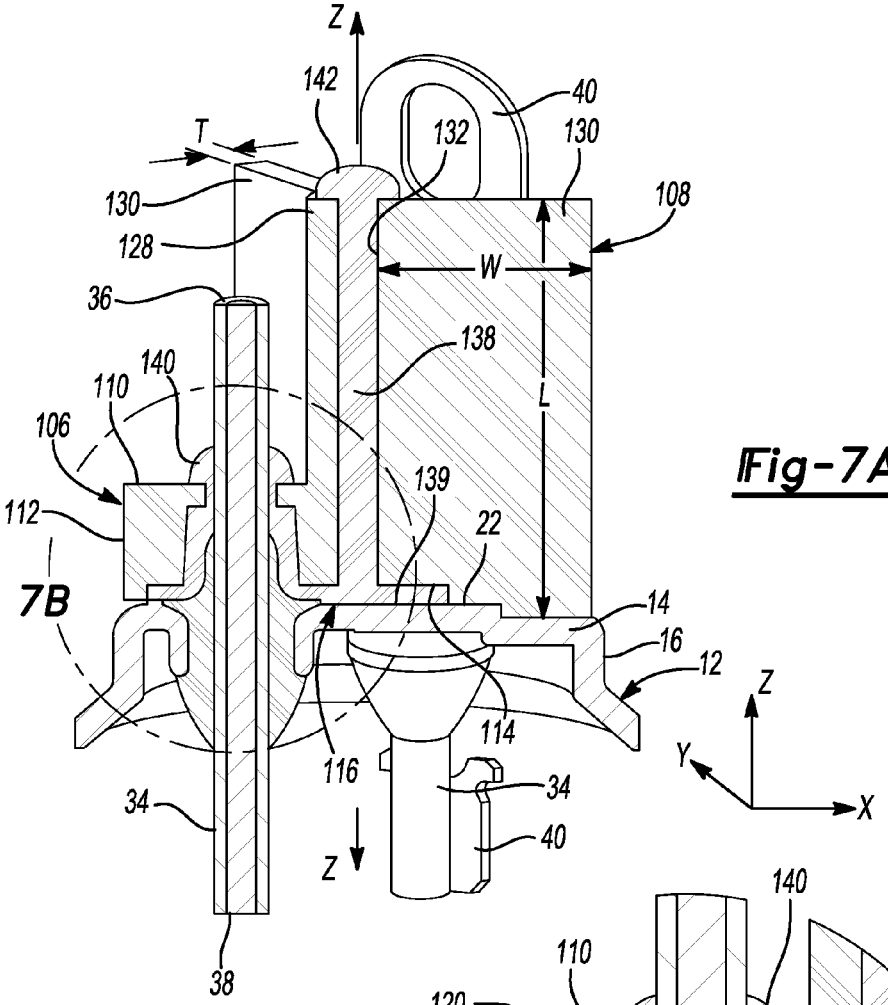
Figure 7B:
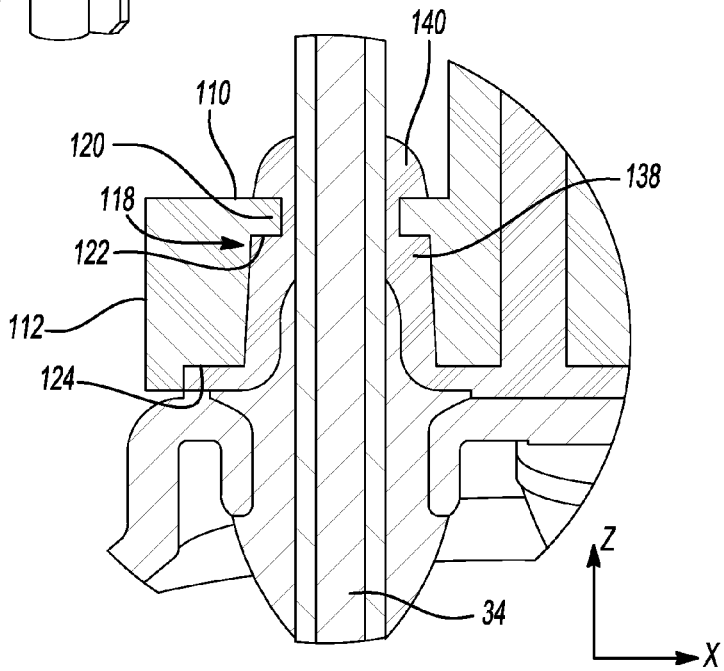
Figure 8:
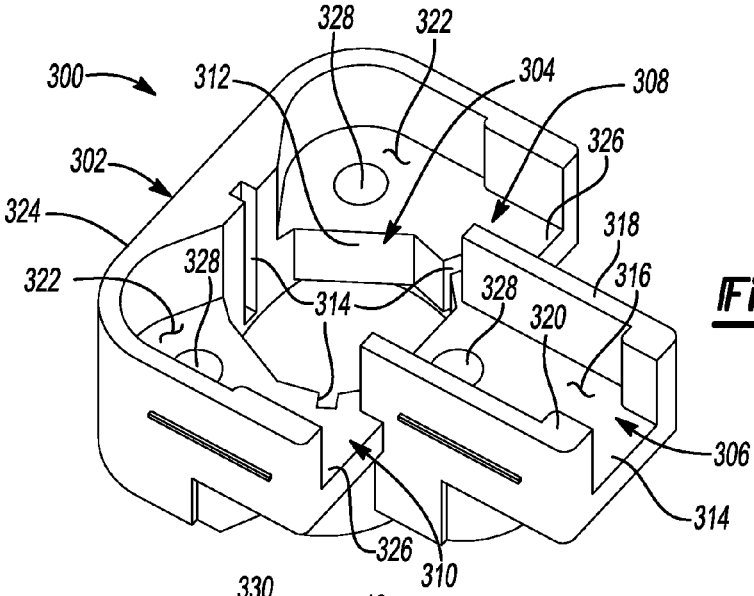
Figure 9A:
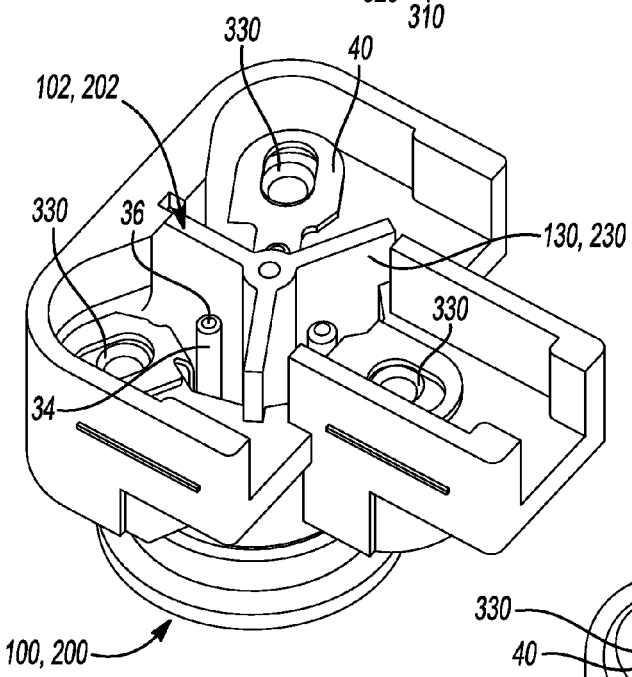
Figure 9B:
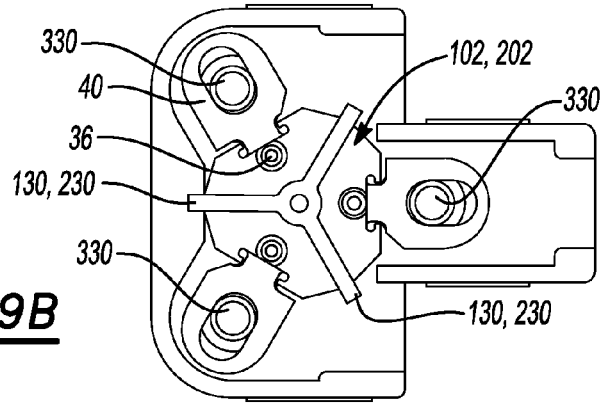

FIG. 7A a cross-sectional front perspective view of the hermetic terminal of FIG. 5;

FIG. 7B is an enlarged detail view of a portion of FIG. 7A;

FIG. 8 is a top perspective view of a connector block of the present disclosure for use with the hermetic terminals of FIGS. 5 and 6;

FIG. 9A is a top perspective view of a hermetic terminal of the present disclosure joined to the connector block of FIG. 8; and FIG. 9B is a top plan view of a hermetic terminal of the present disclosure joined to the connector block of FIG. 8.

Corresponding reference numerals indicate corresponding parts throughout the several views of the drawings.

DETAILED DESCRIPTION

Example embodiments will now be described more fully with reference to the accompanying drawings.

Figure 4A:
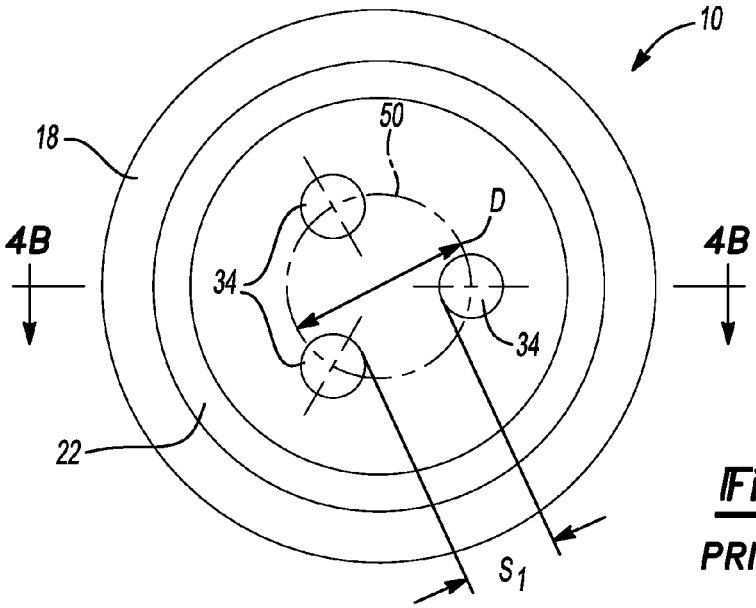
Fig-4A PRIOR ART
FIG. 4A is top plan view of a prior art hermetic terminal.
Figure 4B:
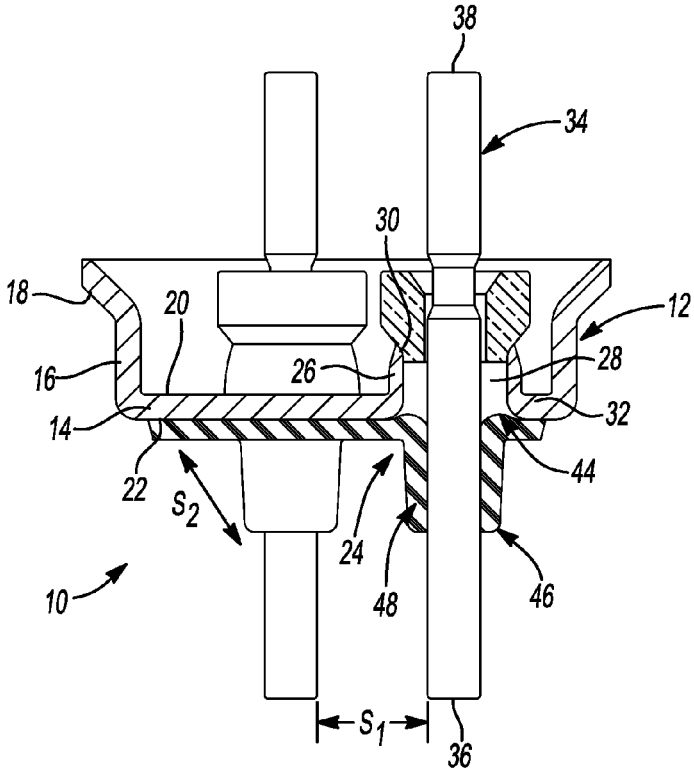
Fig-4B PRIOR ART
FIG. 4B is a cross-sectional side view of a prior art hermetic terminal taken along the line A-A of FIG. 4A.

Conventionally, multi-pin hermetic terminals, such as those shown in FIGS. 4A and 4B, are used in a variety of air-conditioning and refrigeration compressor applications and are designed to meet certain power rating requirements. A significant factor affecting a hermetic terminal's power rating, however, is the amount of through-air spacing between the adjacent conductor pins of the hermetic terminal. In this regard, UL (a/k/a Underwriters Laboratories) provides specifications for a hermetic terminal to be approved for a specified voltage. Moreover, the exterior side of a hermetic terminal (i.e., the side that is exposed to the outside environment) has a more stringent requirement for electrical spacing under UL's specifications. And since the manner in which an electrical connection is made on the exterior side of a hermetic terminal is generally beyond the control of the hermetic terminal manufacturers, the hermetic terminal manufacturers design their hermetic terminals to meet the UL specifications independent of any additional electrical barrier that may be employed by an end user to increase the electrical spacing of the conductor pins after installation of the hermetic terminal, such as a connector block for example.

In multi-pin hermetic terminals, the conductor pins are centered and equally spaced about the terminal in a well-known manner. Referred to as a pin circle, a circle that passes through the center of each of the conductor pins has a diameter that is referred to as the pin circle diameter. Consequently, the power rating of a hermetic terminal is related to its pin circle diameter since an increase in the through-air pin-to-pin spacing of the hermetic terminal can be achieved by an increase in its pin circle diameter. An increase in the pin circle diameter, though, leads to a larger-sized hermetic terminal overall. Thus, a hermetic terminal rated for a lower voltage threshold will traditionally have a smaller overall diameter than a hermetic terminal rated for a higher voltage threshold.

In order to provide some standardization for the hermetic terminals used in air-conditioning and refrigeration compressor applications, two threshold power ratings for hermetic terminals have become established: the 300 volt-rating and the 600 volt-rating. Consequently, industry manufacturers have been able to standardize to two sizes (e.g., diameters) of hermetic terminals that meet the two voltage ratings for air-conditioning and refrigeration compressor applications. This means, for example, that there have to be two different sizes for the cut-out holes in the compressor shell into which the hermetic terminals are installed, and the machines that weld the hermetic terminals into the compressor shell have to be configured to accommodate two different sized hermetic terminals.

The invention of the present disclosure, however, enables a smaller diameter hermetic terminal to meet UL specifications while achieving a voltage rating for applications that would have previously required a larger diameter hermetic terminal. As a result, industry manufacturers can now standardize their designs and tooling to a single-sized hermetic terminal.

Moreover, since a smaller diameter hermetic terminal can be used, the pressure rating for the compressor can be increased. This is because hermetic terminals having a smaller footprint in the compressor can withstand higher pressures, allowing the compressor to have a higher pressure rating and use higher pressure refrigerants. For example, because the hermetic terminal can be manufactured to smaller overall dimensions than conventional terminals, the surface area of the terminal that is exposed to the high pressure environment of the compressor is decreased. Correspondingly, the force acting against the terminal is also decreased (since the pressure remains constant). A decreased force then enables the body of the hermetic terminal to be manufactured from a material having a thickness that is less than that of conventional terminals. Hence, the terminal body may be manufactured on smaller, less expensive tools that can run at higher production speed, thereby increasing manufacturing output.

Referring now to the drawings, and particularly to FIGS. 4A and 4B, a hermetic terminal 10 has a generally cup-shaped metal body member 12 with a generally flat bottom wall 14 and a peripheral side wall 16 having an outwardly flaring rim 18. The bottom wall 14 of the body 12 has a dish-side interior surface 20, an exterior surface 22, and a plurality of openings 24. The openings 24 are each defined by an annular lip 26 with an inside wall surface 28, a free edge 30 on the dish side of the body member 12, and a radius 32 on the exterior surface side of the body member 12. The body member 12 may be manufactured from a metal material such as steel.

Figure 1:
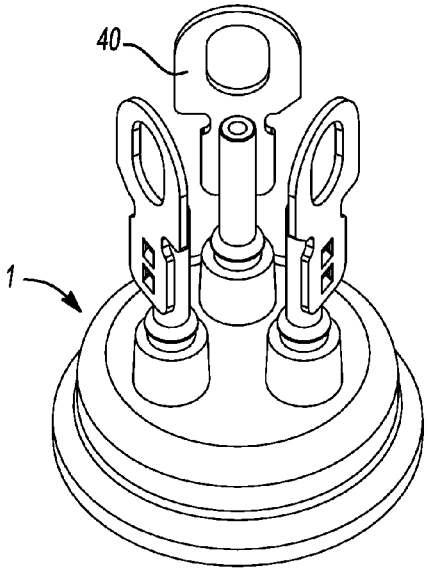
Fig-1 PRIOR ART
FIG. 1 is a top perspective view of a prior art hermetic terminal.
Figure 2:
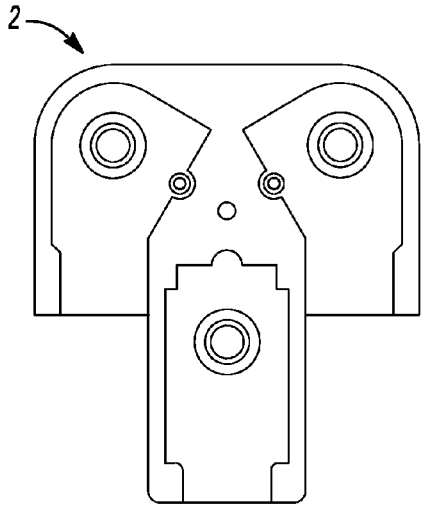
Fig-2 PRIOR ART
FIG. 2 is a top perspective view of a prior art connector block for use with the hermetic terminal of FIG. 1.
Figure 3A:
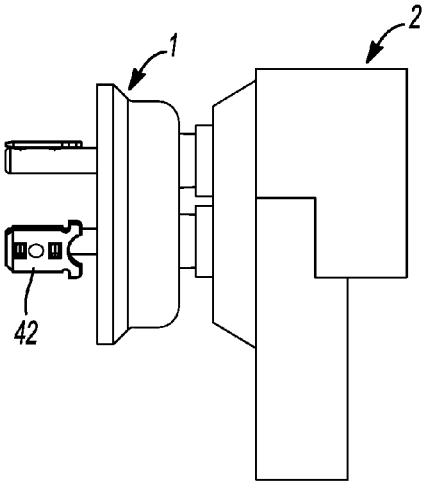
Fig-3A PRIOR ART
FIG. 3A is a side perspective view showing the hermetic terminal of FIG. 1 joined to the connector block of FIG. 2.
Figure 3B:
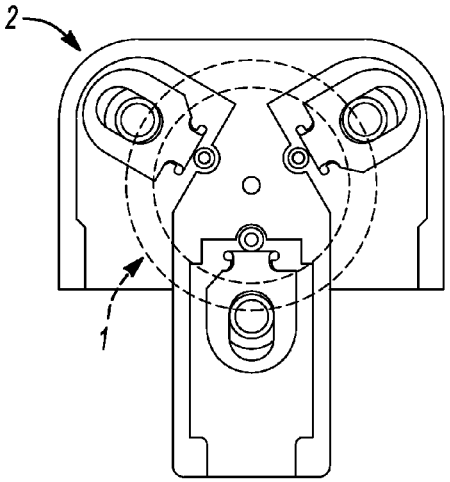
Fig-3B PRIOR ART
FIG. 3B is a top perspective view showing the hermetic terminal of FIG. 1 joined to the connector block of FIG. 2.

A plurality of current-conducting pins 34 extend through corresponding ones of the plurality of openings 24 in the body member 12. Each conductor pin 34 includes an outer end 36 and an inner end 38, which may be fitted with a conventional electrical connection strap 40 or an electrical quick-connect tab 42, best seen in FIGS. 1 and 3A. As shown in FIG. 4A, in multi-pin hermetic terminals the conductor pins 34 are centered and equally spaced about the terminal 10. The conductor pins 34 lie on a pin circle 50 having a pin circle diameter D. As such, the conductor pins 34 have a through-air spacing from pin-to-pin of S1 and from pin-to-body of S2.

The conductor pins 34 may manufactured from an electrically conductive metal material, such as solid copper or steel. Alternatively, a bimetallic, copper-core wire, having high electrical conductivity and possessing good hermetic bonding characteristics may also be utilized.

Each conductor pin 34 is sealed within its respective opening 24 of the body member 12 by a dielectric sealing material 44 that fills the opening 24 and hermetically bonds to both the body member 12 and the conductor pin 34. A suitable sealing material 44 is a sealing glass material that can be fused in the opening 24 and to both the body member 12 and the conductor pin 34. The sealing glass material 44 creates a non-conductive, glass-to-metal seal that is also an airtight hermetic seal between the conductor pin 34 and the body member 12 such that leakage through the hermetic terminal 10, by way of the conductor pin 34 and opening 24, is effectively prevented. Suitable sealing glass materials are well-known in the art.

A layer of a dielectric material forming an insulating member 46 is disposed over the exterior surface 22 of the body member 12 and lower portions 48 of the conductor pins 34 and is secured thereto by an insulating adhesive or the like. The insulating member 46 covers and helps protect the glass-to-metal seal and provides a dielectric over-surface covering for substantial portions of the outside surface 22 of the body member 12 and the conductor pins 34. The insulating member 46 can comprise silicone rubber.

Turning now to the hermetic terminals incorporating the pin-isolating feature 102, 202 of the present disclosure, exemplary embodiments of the disclosed device are illustrated in FIG. 5 at 100 and in FIG. 6 at 200.

With reference to FIGS. 5, 7A and 7B, a first exemplary hermetic terminal 100 incorporating a pin-isolating feature 102 of the present disclosure is illustrated. The pin-isolating feature 102 forms part of the hermetic terminal 100 and serves to effectively increase the operative through-air spacing between the terminal's conductor pins 34 (i.e., the effective through-air pin-to-pin spacing S3) without necessitating a corresponding increase in the diameter of the pin circle and/or the size of the terminal body member 12. Consequently, the power rating for the hermetic terminal 100 can likewise be increased.

As illustrated, the pin-isolating feature 102 generally comprises an integrally formed body 104 made from an insulating, dielectric material. The body 104 of the pin-isolating feature 102 comprises a lower base portion 106 and an upper barrier portion 108. The base portion 106 is sized and shaped to closely fit the periphery of the exterior surface 22 of the bottom wall 14 of the body member 12 of the hermetic terminal 100. The base portion 106 includes an upper surface 110, a side wall 112 and an underside surface 114. The underside surface 114 of the base portion 106 is offset or separated from at least a portion of the exterior surface 22 of the terminal body member 12 and thereby creates an inner cavity portion 116 forming a gap or space between the base portion 106 and the exterior surface 22 of the terminal body member 12.

The pin-isolating feature 102 may comprise a moldable plastic resin material, such as polyphenyl sulfide. A suitable material is generally available under the tradename RYTON.

The base portion 106 of the pin-isolating feature 102 also includes a plurality of openings 118 that both correspond to and align with the plurality of openings 24 in the body member 12 of the hermetic terminal 100 and correspondingly receive the plurality of conductor pins 34 of the hermetic terminal 100. As shown in the enlarged detail view of FIG. 7B, each opening 118 further includes a neck portion 120, a first shoulder 122 that is adjacent to the neck portion 120, and a second shoulder 124 forming a portion of the underside surface 114 of the base portion 106 that is adjacent to the exterior surface 22 of the bottom wall 14 of the terminal body member 12. At the neck portion 120, the openings 118 are in close proximity fit with the conductor pins 34.

The upper barrier portion 108 of the pin-isolating feature 102 includes a central portion 128 and a plurality of generally vertically upstanding, planar ribs 130. The central portion 128 comprises a cylindrical member having a passageway 132 extending therethrough to the underside surface 114 of the base portion 106.

The plurality of generally vertically upstanding, planar ribs 130 extend from the upper surface 110 of the base portion 106 in a direction along a central longitudinal axis Z of the hermetic terminal 100 (which is generally parallel to the longitudinal axes of the conductor pins 34). As illustrated in FIG. 7A, the ribs 130 are shown generally to be rectangularly-shaped, having a length L, a width W, and a thickness T. Although the ribs 130 are illustrated as rectangular, the ribs 130 may take other geometric shapes. In the direction of the Z-axis, the ribs 130 extend longitudinally from the base portion 106 for the length L and terminate beyond the outer ends 36 of the conductor pins 34. In the direction of the X-axis, the widths W of the ribs 130 extend laterally outwardly from the central portion 128 to approximately the peripheral side wall 16 of the terminal body member 12. As shown FIG. 5, the pin-isolating feature 102 includes three ribs 130 extending outwardly from the central portion 128 toward the side wall 16 of the terminal 100 and equally spaced apart at approximately 120 degree intervals to separate the three conductor pins 34 of the hermetic terminal 100. Of course, depending on the configuration of the hermetic terminal 100 more or fewer conductor pins 34 can be present, and the number and spacing of the ribs 130 can vary accordingly.

As shown in FIG. 5, the ribs 130 of the upper barrier portion 108 obstruct a direct, linear, through-air path between adjacent conductor pins 34 of the hermetic terminal 100. As a result, any through-air path from one conductor pin 34 to another conductor pin 34, as shown at lines 134 and 136, comprises a non-linear path that traverses over and/or around the pin-isolating feature 102, increasing the length of the through-air path between conductor pins 34.

Assembly of the pin-isolating feature 102 to the hermetic terminal 100 can be accomplished by securing it to the exterior surface 22 of the body member 12 of the hermetic terminal 100. In this regard, a dielectric injection molding material 138 is injection molded into the inner cavity portion 116. After the injection molding material 138 has cured, the pin-isolating feature 102 becomes bonded to the hermetic terminal 100. Optionally, a dielectric adhesive material 139 (such as an adhesion promoter or primer) can be applied to the exterior surface 22 of the body member 12 and/or the inner cavity portion 116 and/or the conductor pins 34 prior to injection molding to promote good adhesion between the injection molding material 138 and the body member 12 and/or the conductor pins 34 and/or the pin-isolating feature 102.

In one exemplary embodiment, portions of the body 104 of the pin-isolating feature 102 (e.g., the underside surface 114 and openings 118) and the exterior surface 22 of the bottom wall 14 of the hermetic terminal 100 can create a mold cavity for injecting the injection molding material 138 between the pin-isolating feature 102 and the hermetic terminal 100. For example, the pin-isolating feature 102 can first be placed on the hermetic terminal 100 such that the base portion 106 of the pin-isolating feature 102 covers the exterior surface 22 of the body member 12 of the hermetic terminal 100. As previously described, the inner cavity portion 116 is created and the inner cavity portion 116 can serve as a mold cavity for the injection molding material 138. The injection molding material 138 can then be injected into the mold cavity through the passageway 132 in the central portion 128 of the pin-isolating feature 102. The injection molding material 138 can flow to completely occupy the mold cavity, and excess injection molding material 138 can flow out through the openings 118 and passageway 132, if necessary. Once cured, the injection molding material 138 bonds to both the pin-isolating feature 102 and the hermetic terminal 100 (e.g., at both the exterior surface 22 of the body member 12 and the exterior surface of each of the conductor pins 34), securing the components together. The neck portions 120 and first shoulder portions 122 in the openings 118, and the passageway 132 through the central portion 128, assist in creating a suitably strong adhesive bond by increasing the surface area on the pin-isolating feature 102 over which the injection molding material 138 is exposed.

A suitable injection molding material for use with the invention of the disclosure is liquid silicone rubber (LSR). In addition, a dielectric adhesive primer material can also be used for promoting good adhesion between the injection molding material 138, the pin-isolating feature 102 and the terminal 100.

In addition to the adhesive bond that affixes the pin-isolating feature 102 to the hermetic terminal 100, the injection molding material 138 can also create a mechanical connection with features of the body 104 to further enhance the attachment of the pin-isolating feature 102 and the hermetic terminal 100. In this regard, and with reference to FIGS. 7A and 7B, the injection molding material 138 can occupy the space of the openings 118 around opposite sides of the neck portions 120 and between the respective neck portions 120 and conductor pins 34. Further, just outside the openings 118 and adjacent to the upper surface 110 of the base portion 106, upon curing the injection molding material 138 can be formed into an enlarged retaining head 140. Similarly, the injection molding material 138 can flow out of the passageway 132 of the central portion 128 and, upon curing, be formed into another enlarged retaining head 142 against the upper barrier portion 108. The retaining heads 140, 142 can strengthen the connection between the pin-isolating feature 102 to the hermetic terminal 100 by serving the function of a mechanical fastener.

Referring now to FIG. 6, an alternative exemplary hermetic terminal 200 incorporating a pin-isolating feature 202 of the present disclosure is illustrated. The pin-isolating feature 202 preferably comprises an integrally formed body 204 made from an insulating, dielectric material. Suitable materials for forming the pin-isolating feature 202 are silicone rubber or polyphenyl sulfide.

As shown in the figure, the body 204 of the pin-isolating feature 202 comprises a lower base portion 206 and an upper barrier portion 208. The base portion 206 is sized and shaped to fit over the exterior surface 22 of the bottom wall 14 of the body member 12 of the hermetic terminal 200. In addition, the base portion can include collar portions 207 covering portions of the exposed surfaces of the conductor pins 34.

The barrier portion 208 comprises a plurality of generally vertically upstanding, planar ribs 230 that extend from the base portion 206 in a direction along a central longitudinal axis Z2 of the hermetic terminal 200 and generally parallel to the longitudinal axes of the conductor pins 34. As illustrated in FIG. 6, the ribs 230 are shown generally to be rectangularly-shaped, having a length L2, a width W2, and a thickness T2. In the direction of the Z2-axis, the ribs 230 extend longitudinally from the base portion 206 for the length L2 and terminate beyond the ends 36 of the conductor pins 34. In the direction of the X2-axis, the widths W2 of the ribs 230 extend laterally outwardly from the central portion 228 to approximately the peripheral side wall 16 of the terminal body member 12. As also illustrated in FIG. 6, the pin-isolating feature 202 includes three ribs 230 extending outwardly from the central portion 228 toward the side wall 14 of the terminal body member 12 and equally spaced apart at approximately 120 degree intervals. The ribs 230 obstruct a direct, linear, through-air path between adjacent conductor pins of the terminal. As a result, any through-air path from one conductor pin 34 to another conductor pin 34 comprises a non-linear path that traverses over or around the pin-isolating feature, increasing the distance of the through-air path between conductor pins 34, as illustrated at 234 and 236.

In this alternative embodiment, the pin-isolating feature 202 can be secured to the exterior surface 22 of the body member 12 and to the conductor pins 34 of the hermetic terminal 200 by a dielectric adhesive material 239 that is applied to the pin-isolating feature 202 (e.g., at the underside of the base portion 206) and/or the terminal 100 (e.g., on the exterior surface 22 of the body member 12 and/or the conductor pins 34) and provides good adhesion between the pin-isolating feature 202 and the terminal 100.

The pin-isolating feature 202 also provides a dielectric over-surface covering for substantial portions of the exterior surface 22 of the terminal body member 12 and the conductor pins 34 and covers and helps protect the glass seals 44.

Turning now to FIGS. 8, 9A and 9B, a connector block 300 for use with the hermetic terminal 100, 200 incorporating a pin-isolating feature 102, 202 of the present disclosure is shown. The connector block 300 cooperatively engages over the ends 36 of the plurality of conductor pins 34 of the hermetic terminal 100, 200 and provides a mounting fixture for attaching to the hermetic terminal 100, 200 lead wires (not shown) that can be electrically connected to a power source (not shown) disposed on one side of the hermetic terminal 100, 200.

Referring to FIG. 8, the connector block 300 can comprise a unitary plastic body 302 formed from a dielectric plastic material, such as a phenolic. The body 302 generally comprises a T-shape and includes a central passageway 304 and three spaced-apart channels 306, 308 and 310.

The central passageway 304 is sized and shaped to receive the outer ends 36 of the conductor pins 34, including the connecting straps 40 attached to the conductor pins 34, and the pin-isolating feature 102, 202 of the hermetic terminal 100, 200. Included in an outer periphery 312 of the central passageway 304 are alignment slots or guideways 314 that cooperatively engage with the ribs 130, 230 of the pin-isolating feature 102, 202 and appropriately orient the connector block 300 relative to the hermetic terminal 100, 200.

A first, inner channel 306 is generally centered in the body 302 and has a lead wire opening 314 at one end thereof for accommodating a lead wire (not shown). The first channel 306 includes an interior strap mounting surface 316 and opposing side walls 318, 320. Located on each side of the first channel 306 is a second, outer channel 308, 310, each second channel 308, 310 has an interior strap mounting surface 322. Bordering the outer periphery of each second channel 308, 310 is an outer wall 324 which, in cooperation with a corresponding side wall 318, 320 of the first channel 306, provides a lead wire opening 326 at one end of each second channel 308, 310 for accommodating a lead wire (not shown).

The interior strap mounting surfaces 316, 322 of the first and second channels 306, 308, 310 serve as mounting locations for the connecting straps 40 attached to the conductor pins 34 of the hermetic terminal 100, 200. As seen in FIGS. 9A and 9B, the connecting straps 40 can be folded or bent over so as to engage the strap mounting surfaces 316, 322. In addition, the interior strap mounting surfaces 316, 322 also each include an aperture 328 for accommodating a threaded insert 330. The threaded inserts 330 are engaged by threaded fasteners (not shown) that electrically connect lead wires (not shown) to the hermetic terminal 100, 200.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hermetic terminal comprising:

a cup-shaped metallic body member including a generally flat bottom wall and a peripheral side wall, the bottom wall having an exterior surface and a plurality of first openings therein;

a plurality of current-conducting pins, at least one current-conducting pin extending through each first opening;

a dielectric sealing material extending between and hermetically sealing the current-conducting pins within the first openings; and a dielectric pin-isolating feature attached to the body member comprising a lower base portion and an upper barrier portion, the base portion being sized and shaped to closely fit the periphery of the exterior surface of the bottom wall, and the upper barrier portion comprising a plurality of generally vertically-upstanding, generally planar, non-parallel ribs extending from the base portion in a direction generally parallel to a central axis of the hermetic terminal and terminating beyond the outer ends of the current-conducting pins; and wherein the pin-isolating feature increases the operative through-air spacing between the current-conducting pins.

2. The hermetic terminal of claim 1 wherein the base portion comprises an underside surface that is adjacent to at least a portion of the exterior surface of the body member so as to create a cavity between the base portion and the exterior surface.

3. The hermetic terminal of claim 2 further comprising a dielectric injection molding material occupying the cavity.

4. The hermetic terminal of claim 3 wherein the base portion comprises a plurality of second openings respectively aligning with the plurality of first openings in the body member;

wherein the plurality of current-conducting pins are correspondingly received in the plurality of second openings.

5. The hermetic terminal of claim 4 further comprising a dielectric injection molding material in the space between the second openings and the current-conducting pins.

6. The hermetic terminal of claim 5 wherein each second opening comprises a neck portion, a first shoulder adjacent to the neck portion, and a second shoulder forming a portion of the underside surface of the base portion that is adjacent to the exterior surface of the bottom wall of the body member;

wherein the neck portions of the second openings are in close proximity fit with the respective current-conducting pins.

7. The hermetic terminal of claim 4 wherein the injection molding material forms one or more enlarged retaining heads on the upper surface of the base portion adjacent to one or more of the second openings.

8. The hermetic terminal of claim 1 wherein the upper barrier portion further comprises a central portion including a cylindrical member having a passageway extending therethrough to the underside surface of the base portion.

9. The hermetic terminal of claim 8 further comprising a dielectric injection molding material in the passageway.

10. The hermetic terminal of claim 9 wherein the injection molding material forms an enlarged retaining head outside the passageway and against the central portion.

11. The hermetic terminal of claim 1 wherein a through-air path between the current-conducting pins comprises a non-linear path that traverses over or around the pin-isolating feature.

12. The hermetic terminal of claim 11 wherein the pin-isolating feature comprises an integrally-formed body comprising a moldable polymer material.

13. The hermetic terminal of claim 12 wherein the moldable polymer material comprises polyphenyl sulfide.

14. The hermetic terminal of claim 11 wherein the base portion further comprises an upper surface, a side wall, and an underside surface; and wherein a dielectric adhesive material is included between the underside surface and the exterior surface of the body member to attach the pin-isolating feature to the body member.

15. The hermetic terminal of claim 11 wherein a dielectric adhesive material is included between the base portion and the exterior surface of the body member to bond the pin-isolating feature to the body member.

16. A hermetic terminal of claim 1 comprising:

a cup-shaped metallic body member including a generally flat bottom wall and a peripheral side wall, the bottom wall having an exterior surface and a plurality of first openings therein;

a plurality of current-conducting pins, at least one current-conducting in extending through each first opening;

a dielectric sealing material extending between and hermetically sealing the current-conducting pins within the first openings; and a dielectric pin-isolating feature attached to the body member comprising a lower base portion and an upper barrier portion, the base portion being sized and shaped to closely fit the periphery of the exterior surface of the bottom wall, and the upper barrier portion comprising a plurality of generally vertically-upstanding, generally planar ribs extending from the base portion in a direction generally parallel to a central axis of the hermetic terminal and terminating beyond the outer ends of the current-conducting pins;

wherein the ribs are generally rectangularly-shaped, having a length extending longitudinally from the base portion and terminating beyond outer ends of the current-conducting pins and a width extending laterally outwardly from the central axis of the hermetic terminal to approximately the peripheral side wall of the body member; and wherein the pin-isolating feature increases the operative through-air spacing between the current-conducting pins.

17. A hermetic terminal comprising:

a cup-shaped metallic body member including a generally flat bottom wall and a peripheral side wall, the bottom wall having an exterior surface and three first openings therein;

three current-conducting pins, one current-conducting in extending through each first opening;

a dielectric sealing material extending between and hermetically sealing the current-conducting pins within the first openings; and a dielectric pin-isolating feature attached to the body member comprising a lower base portion and an upper barrier portion, the base portion being sized and shaped to closely fit the periphery of the exterior surface of the bottom wall, and the upper barrier portion comprising a plurality of generally vertically-upstanding, generally planar ribs extending from the base portion in a direction generally parallel to a central axis of the hermetic terminal and terminating beyond the outer ends of the current-conducting pins;

wherein the pin-isolating feature comprises three ribs extending from the central axis of the hermetic terminal toward the peripheral side wall of the of the body member and being equally spaced apart at approximately 120 degree intervals; and wherein the ribs separate adjacent current-conducting pins such that the ribs obstruct a direct, linear, through-air path between adjacent current-conducting pins.

18. A hermetic terminal comprising:

a body including a wall having an exterior surface and a plurality of first openings therein;

a plurality of current conducting pins, one current-conducting pin extending through each first opening, the pins sealed within the first openings and electrically isolated from the body;

a dielectric barrier attached to the body, the barrier sized and shaped to closely fit a perimeter of the exterior surface of the wall, the barrier comprising a plurality of ribs, the ribs extending in a first direction generally parallel to a longitudinal axis of the pins and terminating in the first direction beyond the outer ends of the pins; and wherein the barrier increases the operative through-air spacing between the pins.

19. The hermetic terminal of claim 18 further comprising a dielectric adhesive material between the exterior surface of the body and the barrier for attaching the barrier to the body.

20. The hermetic terminal of claim 19 wherein a through-air path between the current-conducting pins comprises a non-linear path that traverses over or around the barrier.

21. The hermetic terminal of claim 19 wherein the barrier is integrally-formed from a moldable polymer material.

22. The hermetic terminal of claim 21 wherein the moldable polymer material comprises one of a phenolic or a liquid silicone rubber.

23. The hermetic terminal of claim 18 wherein the body further includes a peripheral side wall; and wherein the ribs extend in a second direction generally perpendicular to the longitudinal axis of the pins and terminate in the second direction near the peripheral side wall.

24. The hermetic terminal of claim 18 wherein the barrier further comprises a base portion comprising an underside surface that is adjacent to at least a portion of the exterior surface so as to create a cavity between the base portion and the exterior surface.

25. The hermetic terminal of claim 24 further comprising a dielectric injection molding material occupying the cavity.

26. The hermetic terminal of claim 25 wherein the base portion further comprises a plurality of second openings respectively aligning with the plurality of first openings;

wherein plurality of second openings respectively receive the plurality of current-conducting pins.

27. The hermetic terminal of claim 26 wherein the dielectric injection molding material occupies the space between the second openings and the current-conducting pins.

28. The hermetic terminal of claim 27 wherein each second opening comprises a neck portion, a first shoulder adjacent to the neck portion, and a second shoulder forming a portion of the underside surface of the base portion that is adjacent to the exterior surface of the bottom wall of the body member;

wherein the neck portions of the second openings are in close proximity fit with the respective current-conducting pins.

29. The hermetic terminal of claim 27 wherein the base portion further comprises an upper surface; and wherein the injection molding material forms one or more enlarged retaining heads at the upper surface adjacent to at least one of the second openings.

30. The hermetic terminal of claim 25 wherein the barrier further comprises an upper portion, the upper portion comprising the ribs and a central portion comprising a cylindrical member having a passageway extending therethrough to the underside surface of the base portion;

wherein the dielectric injection molding material occupies the passageway.

31. The hermetic terminal of claim 30 wherein the injection molding material forms an enlarged retaining head located outside of the passageway and against the cylindrical member.

32. A hermetic terminal comprising:

a body including a wall having an exterior surface and three openings therein;

three current conducting pins, one current-conducting in extending through each opening, the pins sealed within the openings and electrically isolated from the body;

a dielectric barrier attached to the body, the barrier comprising a plurality of ribs, the ribs extending in a first direction generally parallel to a longitudinal axis of the pins and terminating in the first direction beyond the outer ends of the pins;

wherein the barrier comprises three ribs extending from a central axis of the hermetic terminal toward a peripheral side wall of the of the body, the ribs being equally spaced apart at approximately 120 degree intervals; and wherein the ribs separate adjacent current-conducting pins such that the ribs obstruct a direct, linear, through-air path between adjacent current-conducting pins.

33. The hermetic terminal of claim 32 wherein the shortest through-air path between the adjacent current-conducting pins comprises a non-linear path that traverses over or around the barrier.

* * * * *